US006550153B1

(12) United States Patent
Keith

(10) Patent No.: US 6,550,153 B1
(45) Date of Patent: Apr. 22, 2003

(54) WINDOW TEMPLATE

(76) Inventor: Gary Keith, P.O. Box 662, Augusta, ME (US) 04330

( * ) Notice: Subject to any disclaimer, the term of this patent is extended or adjusted under 35 U.S.C. 154(b) by 0 days.

(21) Appl. No.: 10/012,837

(22) Filed: Dec. 10, 2001

Related U.S. Application Data

(63) Continuation-in-part of application No. 09/867,075, filed on May 29, 2001.

(51) Int. Cl.[7] ..... G01B 3/14; E04F 21/04

(52) U.S. Cl. ..... 33/562; 33/194; 33/482

(58) Field of Search ..... 33/194, 197, 474, 33/478, 482, 562, 563, 565, 566; 428/80, 542.2, 542.8; 434/72, 75, 79, 80

(56) References Cited

U.S. PATENT DOCUMENTS

| | | | | | |
|---|---|---|---|---|---|
| 1,946,961 | A | * | 2/1934 | Blade | 33/194 |
| 2,356,923 | A | * | 8/1944 | Firestone | 33/194 |
| 2,567,771 | A | * | 9/1951 | Hurd | 33/194 |
| 4,285,135 | A | * | 8/1981 | Minozzi, Jr. | 33/197 |
| 4,423,555 | A | * | 1/1984 | Wootten | 33/571 |
| 4,499,666 | A | * | 2/1985 | Smith | 33/562 |
| 4,936,020 | A | * | 6/1990 | Neblett | 33/566 |
| 5,195,249 | A | * | 3/1993 | Jackson | 33/563 |
| RE34,374 | E | * | 9/1993 | Davidson | 33/566 |
| 5,604,988 | A | * | 2/1997 | Costelloe | 33/194 |
| 5,692,357 | A | * | 12/1997 | McCain | 33/194 |
| 6,213,576 | B1 | * | 4/2001 | Muller et al. | 312/223.1 |

* cited by examiner

*Primary Examiner*—G. Bradley Bennett
(74) *Attorney, Agent, or Firm*—Patricia M. Mathers; Thomas L. Bohan

(57) ABSTRACT

A template for installing windows in a wall having studs and a wall panel. The template is for a specific shape and size of window and provides the proper dimensions for receiving the window casing and for framing the studs to receive the casing.

15 Claims, 3 Drawing Sheets

WINDOW TEMPLATE

This application is a Continuation-in-Part of the co-pending, commonly owned U.S. application Ser. No. 09/867,075, filed on May 29, 2001.

BACKGROUND INFORMATION

1. Field of the Invention

The invention relates to the field of window installation. More particularly, this invention relates to the installation of non-rectangular shaped windows in sheet rock and stud walls.

2. Description of the Prior Art

When constructing a building, openings are often cut into wall panels and through wall studs to provide space for a window and window casing that is inserted into the opening. Also, windows are often installed in an already finished construction. In both cases, the wall panel, typically made of sheet rock or drywall, and the studs have to be cut through to provide space for the window.

Today, many decorative windows are of unusual shape, such as hexagonal, oval, octagonal, triangular shape, etc. With conventional rectangular windows it is already a challenge to precisely match the size and shape of the opening cut in the wall with that of the window casing that is inserted, but with these decorative shapes, the job is even harder to accomplish accurately. A number of attempts have been made over the years to solve this problem. Most of these attempts include adjustable template devices for cutting and framing openings for doors and windows. The main disadvantage of most templates is that each one is adaptable to serve as a template for a variety of sizes and shapes of window and door openings and, as a result, the template can be quite complicated to use.

In housing construction today, a sheet rock installer may have unskilled workers assisting him or her, and ideally wants to work with clear specific instructions and easy-to-use tools that require little or no decision-making in interpreting the proper use of the tool. Also, many do-it-yourselfers go to a home supply store, such as HOME DEPOT, and buy windows for retrofitting into an already finished wall. The windows come with instructions on how to fit them into the wall, but, if the window is an unusual shape, the homeowner may lack the skill required to properly measure and cut an accurately sized opening through the sheet rock and the wall studs and may end up with much more finish work than was initially anticipated.

What is needed, therefore, is a template for a specific size and shape of window that is inexpensive and easy to use. What is further needed is a set of such templates that includes a template for each type of window that is typically installed in particular type, style, or model of housing construction.

BRIEF SUMMARY OF THE INVENTION

For the reasons cited above, it is an object of the present invention to provide a window template for a particular size and shape of window. It is a further object to provide a set of templates that includes the majority of sizes and shapes of windows installed in a particular type, style, or model of housing construction.

The objects are achieved by providing a template for a window opening in a wall constructed of a wall panel and wall studs. The objects are also achieved by providing a set of templates for the various sizes and shapes of windows typically installed in a particular type, style, or model of housing.

The template according to the present invention is a flat shape, made of plastic, sheet metal, or other suitably stiff and form-rigid material. The template has an outer perimeter and an inner perimeter, and the distance between the two perimeters corresponds to the thickness of the stud framing that typically needs to be replaced when cutting an opening greater than the distance between the wall studs. Thus, the inner dimensions of the template correspond to the dimensions of the window casing to be installed and the outer dimensions to the outer perimeter of the stud framing that has to be provided to support the window and the studs. For example, if the stud thickness is 1½", then the difference between the inner and outer perimeter of the template is also 1½".

When installing a window in a wall that is under construction, once the desired location of the window is determined, the studs are cut along the outer perimeter of the template. The opening is then framed to the octagonal hexagonal, oval, etc. shape. The template is then placed on the wall panel in the appropriate location, the inner perimeter of the template traced on the panel, and the panel then cut and the portion for the window opening removed. The window casing will fit into the wall opening and the finish-framing provided with the window product can be installed around the window on the wall to cover the stud framing.

The template according to the invention is particularly useful for the installation of decorative shapes of windows. Today, it is possible to purchase readymade windows in a wide variety of shapes, such as oval, hexagonal, octagonal, and semi-circular, and triangular, and also in a range of sizes. The template includes auxiliary guides to ensure perfect alignment of the installed window, even those windows of irregular shape. For example, mounting holes are provided in the template so that the template can be temporarily fastened in place on a wall panel or up against the wall studs. This allows the installer to fasten the template in place and then to measure the horizontal and/or vertical position of the template, before any cutting is done. Once it is determined that the template is properly aligned, the panel and/or studs can then be cut around the outer perimeter of the template, using a universal router bit, or cut-lines can be drawing with a pencil or other marking device. Pairs of alignment notches are also provided on the template, to simplify the task of determining alignment. One need only place a level against the template, an edge of the level aligned with one pair of notches, to determine the proper vertical and/or horizontal alignment of the window.

The template is made of sheet material and manufactured in a process that requires a minimum of finishing work. Thus, the template can be a stamped piece of sheet metal, such as aluminum, or a cut piece of wood, wood chip or wood fiber panel, plastic material, coated paper, etc. Ideally, several sizes of a particular shape can be placed concentrically to each other on a sheet, as a means of utilizing the material most efficiently.

DETAILED DESCRIPTION OF THE EMBODIMENTS OF THE INVENTION

FIGS. 1 through 6 each show a template 1 to be used as a cutting aid when installing a window in a wall that is constructed of sheet rock and studs. The Preferred Embodiment of the template 1 is a flat piece cut or stamped from sheet metal, having a width W that is the distance between an outer perimeter P and an inner perimeter p. The width W corresponds to the actual standard thickness dimension of a stud used in a stud wall. So, for example, if the studs are 2"×6",and the actual planed stud thickness of the stud is 1½", the width W of the template 1 is 1½". Other embodiments of the template according to the invention may be cut or stamped from any suitable material, that is, from any material that has the necessary rigidity and durability to adequately serve as a template in a construction environment. It is also within the scope of the invention to provide templates that are disposable, made from a material that is not necessarily long-lasting, but that provides the stiffness and accuracy of shape and form to serve as a template. Such templates may be made of plastic materials, pulp fiber materials, pressed materials, etc.

The template 1 is provided in a variety of shapes, as shown in FIGS. 1–6 and in a range of sizes. The invention is, of course, not limited to the shapes illustrated in the FIGS. Other atypical shapes for windows may come into vogue, and a template according to the invention may be provided for that new shape.

Figure 1:
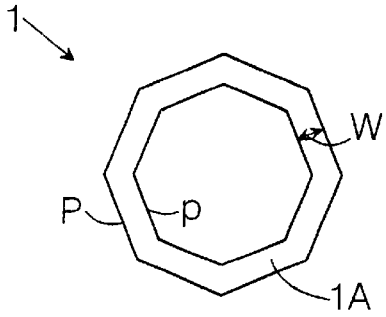
FIG. 1 is a frontal view of a template according to the invention for installing an octagonal window.
Figure 2:
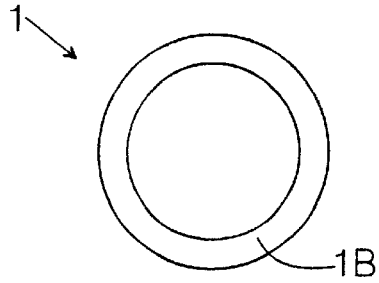
FIG. 2 is a frontal view of a template according to the invention for installing a round window.
Figure 3:
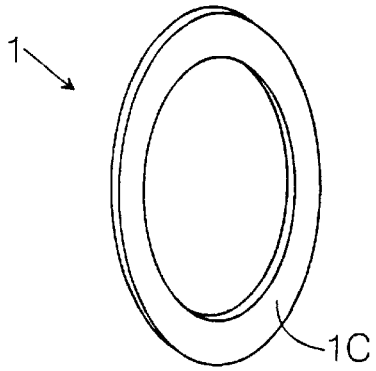
FIG. 3 is a perspective view of a template according to the invention for installing an oval window.
Figure 4:
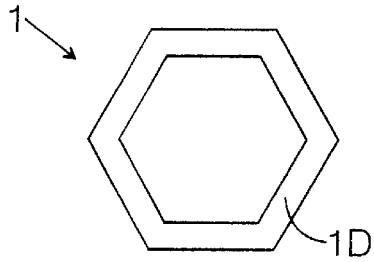
FIG. 4 is a frontal view of a template according to the invention for installing a hexagonal window.
Figure 5:
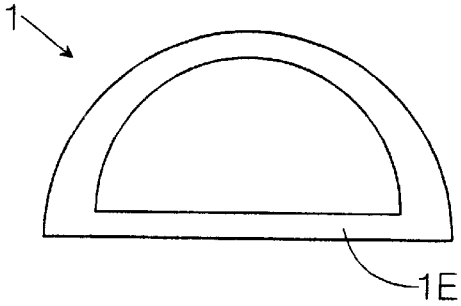
FIG. 5 is a frontal view of a template according to the invention for installing a fan light window.
Figure 6:
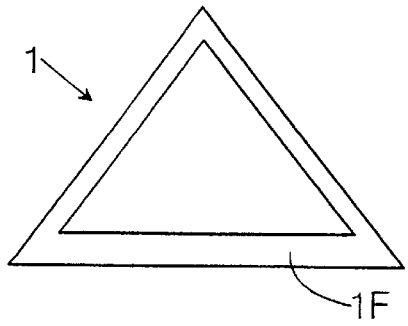
FIG. 6 is a frontal view of a template according to the invention for installing a triangular window.
Figure 7A:
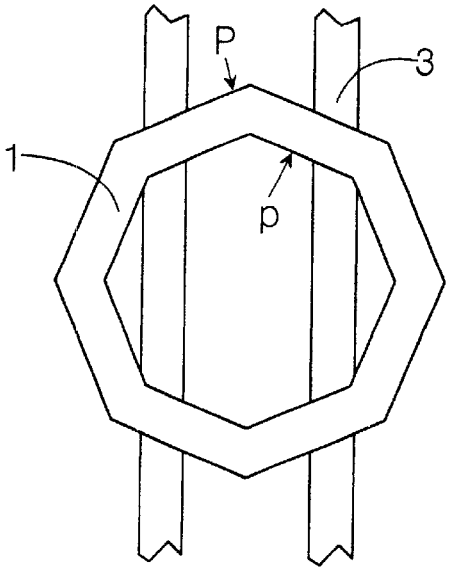
FIG. 7A illustrates the use of the template according to the invention to determine the proper cut through wall studs on a wall under construction.
Figure 7B:
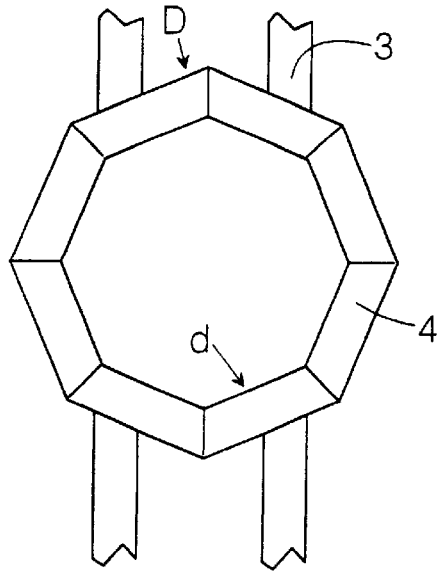
FIG. 7B illustrates the framing required to support the studs and receive a window casing on a wall under construction (prior art).

The template 1 according to the invention serves as a labor- and time-saving device for installing windows in walls that are under construction or are already finished walls. When working on an unfinished wall, the template 1 is held in place where the window is to be installed and, as shown in FIG. 7A, studs 3 that would interfere with the window are cut along the outer perimeter P of the template 1. Subsequently, as shown in FIG. 7B, a frame 4 for the window is constructed in the wall studs 3, whereby an inner dimension d of the frame corresponds to the inner perimeter p of the template 1.

Figure 8:
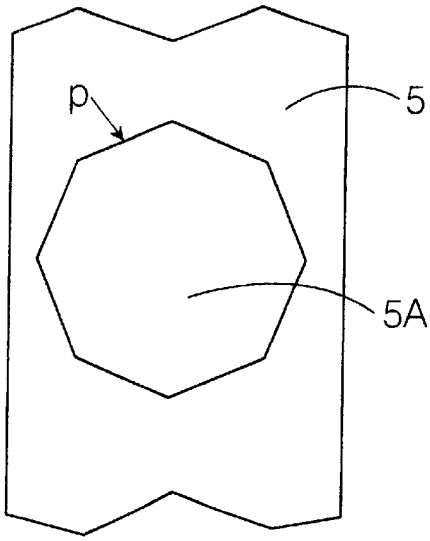
FIG. 8 illustrates the use of the template according to the invention to determine the proper cut through a sheet rock panel for a wall under construction.

FIG. 8 illustrates an opening 5A corresponding in size to the inner perimeter p of the template 1 cut into a sheet rock panel 5 in the location that will be placed over the wall studs 3. The window casing of the window can now be inserted into the frame 4 and the wall panel opening 5A. The use of the template 1 has eliminated the need for tedious and exact calculations and ensures that the frame 4 in the wall studs 3 and the opening 5A in the wall panel 5 are properly sized to receive the window casing, without requiring unnecessary finishing work.

Figure 9:
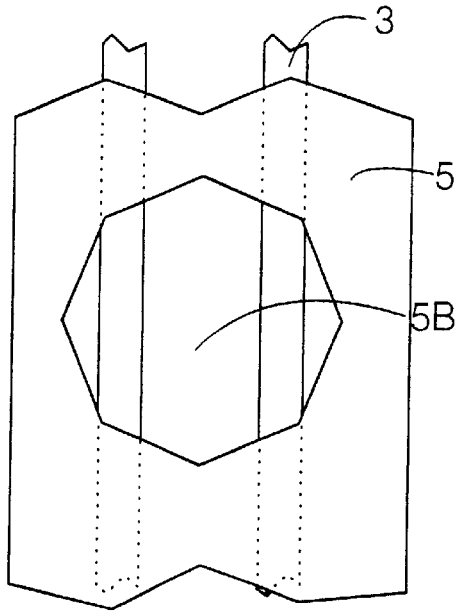
FIG. 9 illustrates the use of the template according to the invention to determine the proper cut through a sheet rock panel in a finished wall.

FIG. 9 illustrates the use of the template 1 according to the invention when installing an octagonal window in a finished wall. An opening 5B that corresponds in size to the outer perimeter P of the template 1 is cut into the wall panel 5 at the desired location. The exposed wall studs 3 are cut through and the frame 4 for receiving the window casing is constructed to support the wall studs 3. The window casing is inserted into the wall panel 5 and the frame 4. The 1½" distance between the edge of the wall panel 5 and the window casing can be filled in with suitable filler. The frame that is provided with the finished window product is large enough to cover this section of the wall panel 5.

Figure 10:
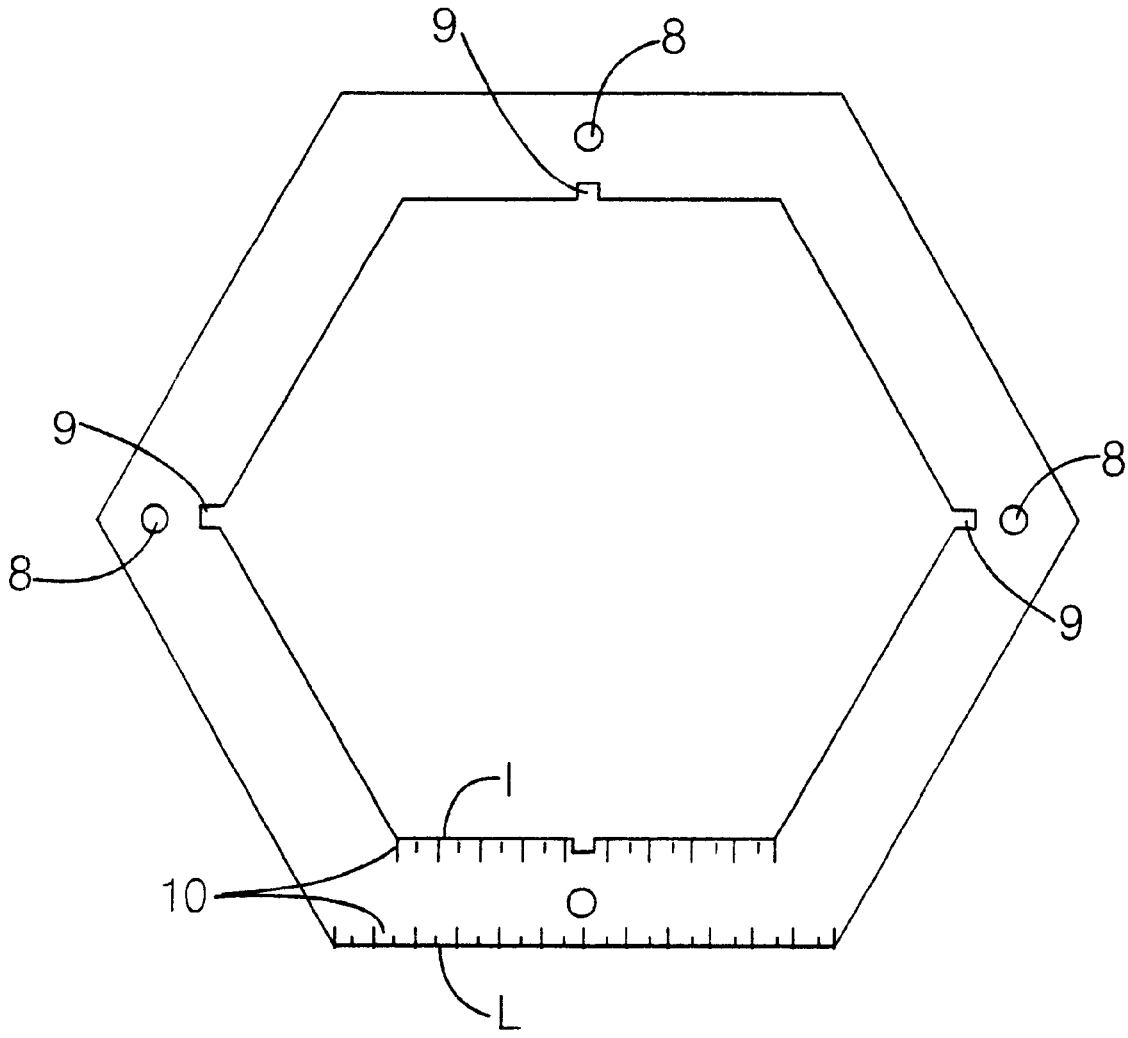
FIG. 10 shows a template according to the invention provided with auxiliary installation aids.

FIG. 10 shows an alternative embodiment of the template 1 according to the invention that is provided with auxiliary installation aids. Mounting holes 8, one or more pairs of alignment guides 9, and/or gradation lines 10 are provided in the template 1 to simplify installation and, at the same time, ensure proper alignment of the window to be installed. As seen in FIG. 10, the mounting holes 8 are evenly spaced around the template. The purpose of these mounting holes 8 is to temporarily fasten the template 1 to the wall panel or section of finished wall in which a window is to be installed and to hold the template in place while the studs are cut around the outer perimeter of the template or the panel is cut around the inner perimeter. The pairs of alignment guides 9 provide a guide surface against which a masonry level can be held, in order to determine the proper vertical and/or horizontal alignment of the template. These alignment guides 9 can be raised surfaces or notches, or other suitable means for seating or locating a level. The gradation lines, shown by way of example only on one section of the template 1, give a first length I corresponding to the inner dimension d and a second length L corresponding to the outer dimension D of one section of the template 1.

The template 1 can be provided as a single template, or provided in sets for use in construction firms. For example, a complete set of templates for octagonal windows includes the typical sizes for that shape of window that are available. Or, a set of templates can include various shapes of windows having a particular major dimension.

The embodiments of the template mentioned herein are merely illustrative of the present invention. It should be understood that variations in construction of the present invention may be contemplated in view of the following claims without straying from the intended scope and field of the invention herein disclosed.

What is claimed is:

1. A template for use as an installation aid for installing a window in a wall having wall studs, said studs having a thickness dimension, and said window having a window casing, said template comprising a flat shape having an outer template perimeter, an inner template perimeter, and a template width that is a distance between said outer perimeter and said inner perimeter, wherein said template width corresponds to said thickness dimension of said studs, and said template inner perimeter corresponds in size to an outer perimeter of said window casing.

2. The template of claim 1, wherein said window is octagonal in shape.

3. The template of claim 1, wherein said window is hexagonal in shape.

4. The template of claim 1, wherein said window is oval in shape.

5. The template of claim 1, wherein said window is triangular in shape.

6. The template of claim 1, wherein said window is circular in shape.

7. The template of claim 1, wherein said window is semi-circular in shape.

8. The template of claim 1, wherein mounting holes are provided on said template between said outer template perimeter and said inner template perimeter, for temporarily mounting said template on said wall or on said wall studs.

9. The template of claim 1, wherein at least one pair of alignment guides is provided on said template, each pair of alignment guides providing a linear alignment guide for properly aligning said template.

10. The template of claim 9, wherein one pair of said alignment guides provides a vertical alignment guide.

11. The template of claim 9, wherein one pair of said alignment guides provides a horizontal alignment guide.

12. The template of claim 1, wherein a first linear dimension is indicated on said inner template perimeter of a particular section of said template and a second linear dimension is indicated on said outer template perimeter of said particular section.

13. The template of claim 12, wherein said first linear dimension includes a first linear scale and said second linear dimension includes a second linear scale.

14. A kit of templates according to claim 1, comprising a plurality of templates for installing windows of different sizes.

15. A kit of templates according to claim 1, comprising a plurality of templates for installing windows of different shapes.

* * * * *